US009388985B2

(12) United States Patent
Wu et al.

(10) Patent No.: US 9,388,985 B2
(45) Date of Patent: Jul. 12, 2016

(54) PREMIXING APPARATUS FOR GAS TURBINE SYSTEM

(75) Inventors: Chunyang Wu, Greer, SC (US); Derrick Walter Simons, Greenville, SC (US); Jonathan Dwight Berry, Greenville, SC (US); Michael John Hughes, Greenville, SC (US)

(73) Assignee: General Electric Company, Schenectady, NY (US)

( * ) Notice: Subject to any disclaimer, the term of this patent is extended or adjusted under 35 U.S.C. 154(b) by 952 days.

(21) Appl. No.: 13/194,385

(22) Filed: Jul. 29, 2011

(65) Prior Publication Data

US 2013/0025284 A1 Jan. 31, 2013

(51) Int. Cl.

| | |
|---|---|
| ***F23R 3/14*** | (2006.01) |
| ***F23R 3/28*** | (2006.01) |
| ***F23R 3/34*** | (2006.01) |

(52) U.S. Cl.

CPC . *F23R 3/14* (2013.01); *F23R 3/286* (2013.01); *F23R 3/34* (2013.01); *F05B 2260/96* (2013.01); *F23R 2900/00014* (2013.01)

(58) Field of Classification Search

CPC ..... F23R 3/14; F23R 3/286; F23R 3/34; F23R 2900/00014; F05B 2260/96

USPC ..... 60/737, 746, 747, 748

See application file for complete search history.

(56) References Cited

U.S. PATENT DOCUMENTS

| | | | | |
|---|---|---|---|---|
| 2,606,066 | A * | 8/1952 | Thompson | F02C 7/228 123/454 |
| 4,222,232 | A | 9/1980 | Robinson | |
| 5,361,586 | A * | 11/1994 | McWhirter et al. | 60/737 |
| 5,797,268 | A * | 8/1998 | Ryan | 60/748 |
| 6,026,645 | A * | 2/2000 | Stokes et al. | 60/737 |
| 6,394,791 | B2 * | 5/2002 | Smith et al. | 431/170 |
| 6,415,608 | B1 | 7/2002 | Newburry | |
| 6,438,961 | B2 | 8/2002 | Tuthill et al. | |
| 6,993,916 | B2 | 2/2006 | Johnson et al. | |
| 2005/0210880 | A1 * | 9/2005 | Inoue et al. | 60/776 |
| 2006/0005542 | A1 * | 1/2006 | Campbell | F02C 6/00 60/723 |
| 2006/0236700 | A1 * | 10/2006 | Saitoh | F23R 3/14 60/737 |
| 2009/0301598 | A1 * | 12/2009 | Rubio | F23C 13/06 138/177 |

(Continued)

FOREIGN PATENT DOCUMENTS

| | | | |
|---|---|---|---|
| CN | 1932380 | A | 3/2007 |
| EP | 2211111 | A2 | 7/2010 |
| EP | 2407720 | A2 | 1/2012 |

OTHER PUBLICATIONS

Lefebvre "Gas Turbine Combustion" 1998, 2nd Edition, Edward Brothers, p. 130.*

(Continued)

*Primary Examiner* — Gerald L Sung
*Assistant Examiner* — William Breazeal
(74) *Attorney, Agent, or Firm* — Nixon & Vanderhye P.C.

(57) ABSTRACT

A premixing apparatus for a gas turbine system includes non-swirl elements around a periphery of a face of a premixing apparatus and a swirl assembly located substantially at a center of the face. The non-swirl elements premix a premixture prior to the premixture being delivered to a combustor of the gas turbine system. The swirl assembly disturbs a flow of fluid prior to the fluid being delivered to the combustor. The premixture includes fuel and oxidant, and the fluid disturbed by the swirl assembly includes the oxidant or the premixture.

6 Claims, 12 Drawing Sheets

(56) References Cited

U.S. PATENT DOCUMENTS

| | | | | |
|---|---|---|---|---|
| 2010/0008179 | A1 | 1/2010 | Lacy et al. | |
| 2010/0175380 | A1* | 7/2010 | Davis, Jr. | F23R 3/286 60/734 |
| 2010/0186413 | A1 | 7/2010 | Lacy et al. | |
| 2010/0192581 | A1 | 8/2010 | Ziminsky et al. | |
| 2010/0192583 | A1* | 8/2010 | Cano Wolff | F23C 9/006 60/737 |

OTHER PUBLICATIONS

Columbia.edu "Gaseous composition of dry air" 2005 http://eesc.columbia.edu/courses/ees/slides/climate/table_1.html.*

Beedie, "GE's H-Series Breaks 60% Fuel Efficiency Barrier", 2007 p. 3 and 4.*

Sound Proofing Company, "Significance of Air Cavity Depth & Triple Leaf Effect", 2012, p. 4.*

EP Search Report issued on Apr. 13, 2015 for corresponding EP application 12176639.8.

Unofficial translation of CN Office Action, issued Apr. 20, 2015, relating to corresponding CN application 201210265161.4.

Unofficial English translation of Chinese Office Action issued in connection with corresponding CN Application No. 201210265161.4 on Nov. 27, 2015.

* cited by examiner

PREMIXING APPARATUS FOR GAS TURBINE SYSTEM

The subject matter of the present invention relates generally to a gas turbine system. In particular, one or more aspects of the present invention relate to a premixing apparatus to premix fuel, oxidant, diluents, other gas mixture, or any combinations thereof prior to combustion in a combustor of the gas turbine system.

BACKGROUND OF THE INVENTION

In gas turbine systems, fuel and air are combusted in a combustor of the system to generate high temperature, high pressure working gases. The turbine converts the expansion of the working gases over the turbine blades into mechanical energy, which then can be used to do useful work such as generating electricity.

It is generally known that increasing the temperature in the reaction zone of the combustor can enhance the efficiency of the gas turbine systems. It is also generally known that the formation of oxides of nitrogen ($NO_x$) increases with the peak temperature in the combustor. Dry-low $NO_x$ (DLN) gas turbine systems minimize the undesirable $NO_x$ formation by premixing fuel and air before combustion so that the temperature stratification in the combustion zone is significantly reduced to reduce the peak temperature and the temperature field within the combustor is as uniform as possible.

One of the major constraints for advanced DLN combustor development is combustion dynamics, i.e. acoustics-related dynamic instability during combustion operation. High amplitudes of dynamics are often caused by the fluctuations in temperature fields (heat release) and pressure oscillations within the combustor chamber. Such high dynamics can impact hardware life and system operability of an engine, leading such problems as mechanical and thermal fatigue, which lead to hardware damage, system inefficiencies, unexpected flame blowout, and compromise in emission performances.

There have been multiple attempts to mitigate combustion dynamics, so as to prevent degradations of combustion performances. Conventionally, the basic methods in an industrial gas turbine combustion system include passive control and active control. Passive control refers to the usage of combustor hardware design features and characteristics to reduce either dynamic pressure oscillations or heat release levels or both. On the other hand, active control can be achieved through the introduction of pressure or temperature fluctuations, which are suitably controlled, to adjust the coupling between heat release and pressure oscillations so as to reduce amplitudes of combustion dynamics.

It is known that combustion dynamics are increased when the heat release and pressure fluctuations are in phase. Therefore, common solutions to mitigate dynamics are featured with dephasing the heat release and pressure fluctuations in the combustor. One representative apparatus used to address some dynamics concerns in gas turbine combustors is a resonator. However, its application has been limited to the attenuation of high frequency (i.e. greater than 1000 Hz) instabilities by pure absorption of acoustic energy. In addition, the installation of a resonator is accompanied with air management, which sometimes is not desirable for premixing designs for low emission performance.

Thus, it is desirable to provide a premixing apparatus that minimizes the combustion dynamics while retaining the low emission characteristics without introduction of pure dynamics-mitigation apparatus.

BRIEF SUMMARY OF THE INVENTION

A non-limiting aspect of the present invention relates to a premixing apparatus for a gas turbine system. The apparatus comprises a plurality of non-swirl elements distributed around a periphery of a face of the premixing apparatus. Each non-swirl element is arranged to premix a premixture prior to the premixture being delivered to a combustor of the gas turbine system for combustion. The apparatus also comprises a swirl assembly located substantially at a center of the face of the premixing apparatus so as to be surrounded by the plurality of non-swirl elements. The swirl assembly is arranged to disturb a flow of fluid prior to the fluid being delivered to the combustor. The swirl assembly includes a plurality of swirl vanes. The premixture includes fuel and oxidant, and the fluid disturbed by the swirl assembly includes the oxidant or the premixture.

Another non-limiting aspect of the present invention relates to a premixing apparatus for a gas turbine system. The apparatus comprises one or more non-swirl elements distributed about a face of the premixing apparatus. Each non-swirl element is arranged to premix a premixture prior to the premixture being delivered to a combustor of the gas turbine system for combustion. The apparatus also comprises one or more swirl assemblies distributed about the face of the premixing apparatus. Each swirl assembly is arranged to disturb a flow of fluid prior to the fluid being delivered to the combustor. Each swirl assembly includes a plurality of swirl vanes. The premixture includes fuel and oxidant, and the fluid disturbed by each swirl assembly includes the oxidant or the premixture.

BRIEF DESCRIPTION OF THE DRAWINGS

These and other features of the present invention will be better understood through the following detailed description of example embodiments in conjunction with the accompanying drawings, in which.

DETAILED DESCRIPTION OF THE INVENTION

A premixing apparatus of a gas turbine combustor is described. The described apparatus achieves low dynamics with little to no sacrifice in low emissions performance. Due at least in part to the low-dynamics achieved by the novel premixing apparatus, the operation life of the combustor hardware can be maintained or increased.

Figure 1:
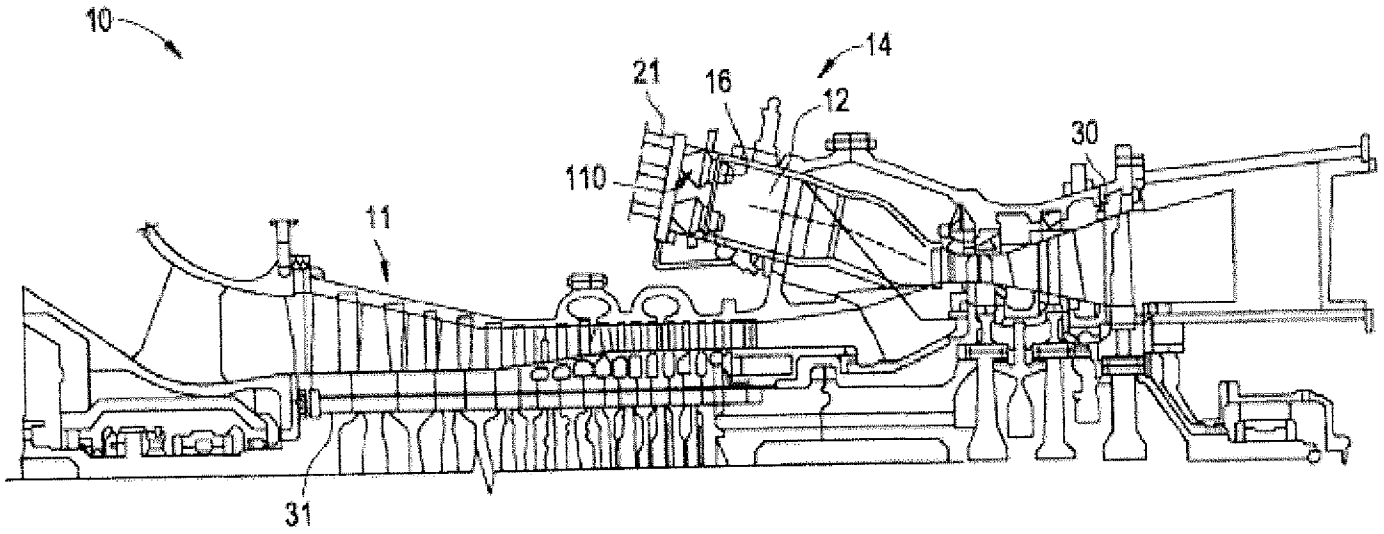
FIG. 1 illustrates a cross-section of an example gas turbine system.

FIG. 1 illustrates a cross-section of an example gas turbine system. The system 10 includes a compressor 11 and a combustor 14. The combustor 14 includes a wall 16 to define a combustion chamber 12. One or more premixing nozzles 110 extend through the wall 16 and into combustion chamber 12. Fuel inlets 21 supply the premixing apparatus 110 with fuel, which is premixed with compressed air from the compressor 11 before combustion. More generally, it can be said that fuel and oxidant are premixed. Diluents, other gas mixture, and any combination thereof can also be premixed with fuel and oxidant and passed into the combustion chamber 12 where the mixture is ignited to form a high temperature, high pressure working gas. A turbine 30 converts the thermal energy of the working gas from the combustor 14, which rotates a shaft 31, into mechanical energy. While a single combustor 14 is shown, the turbine system can includes multiple combustors.

Figure 2:
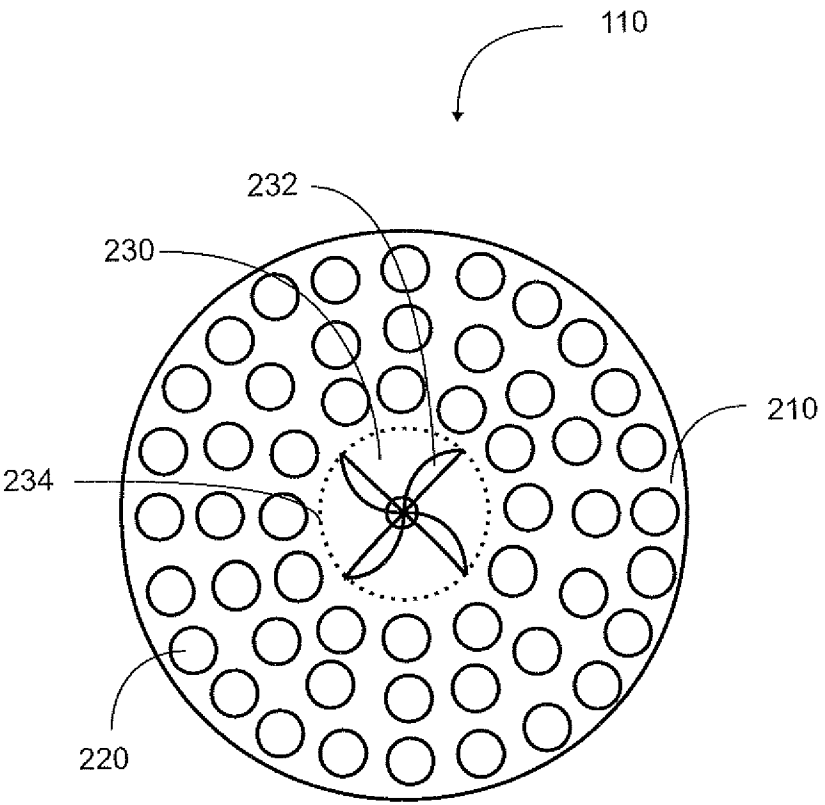
FIG. 2 illustrates a premixing apparatus according to an embodiment of the present invention.

In a non-limiting aspect, both swirl and non-swirl techniques are utilized to premix fuel, oxidant, diluents, other gas mixture, and their combinations. FIG. 2 illustrates a non-limiting embodiment of a premixing apparatus 110 that may be used to premix fuel, oxidant, diluents, other gas mixture, or any combinations thereof for the gas turbine system 10. In particular, a face 210 of the premixing apparatus 110 that faces the combustion chamber 12 is shown. In the figure, the face 210 is shown to be circular. However, the shape of the face is not limited thereto—it can be a triangle, square, rectangle, ellipse, and so on.

The premixing apparatus 110 includes one or more non-swirl elements 220. The non-swirl elements 220 premix the fuel and oxidant prior to delivering the fuel and oxidant mixture to the combustion chamber 12. In addition to the fuel and oxidant, the non-swirl elements 220 may also premix diluents, other gas mixtures, or any combination thereof. For ease of reference, a phrase "premixture" will be used to refer to the fuel and oxidant along with zero or more liquids, zero or more diluents and zero or more other gas mixtures to be premixed. In other words, the premixture, in addition to the fuel and oxidant, can include any combination of liquids, diluents, and gas mixtures. Diluents can be inert. Also, some gas mixtures can be partially or wholly reacted.

Figure 3:
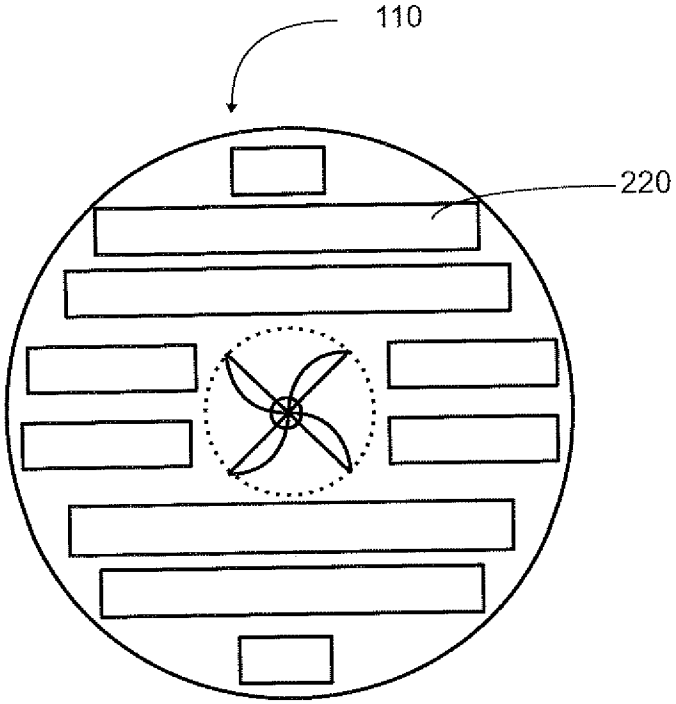
FIG. 3 illustrates a premixing apparatus according to an embodiment of the present invention.

While multiple non-swirl elements 220 are shown in the FIG. 2, the number of non-swirl elements 220 can be as few as one. Also, while the non-swirl elements 220 are shown to be circular, the shape is not so limited. For example, as illustrated in FIG. 3, the non-swirl elements 220 may be rectangularly shaped. When there are multiple non-swirl elements 220, there can be a mixture of shapes (e.g. round, triangle, rectangle, polygon, etc.) and a mixture of sizes, and the sizes and shapes need not correspond to each other. That is to say, similarly shaped elements need not be similarly sized and similarly sized elements need not be similarly shaped.

Referring back to FIG. 2, the premixing apparatus 110 also includes one or more swirl assemblies 230 (only one is shown in FIG. 2). The premixing apparatus 110 may also be referred to as a "hybrid" in that both swirl assembly or assemblies 230 and non-swirl element or elements 220 are utilized. Each swirl assembly 230 may include swirl vanes 232 and a shroud 234 surrounding the swirl vanes 232. The shroud 234 is dashed to indicate that it is optional. Again, while the swirl assembly 230 is shown to be circular, the shape is not so limited, i.e., the swirl assembly 230 can be of any shape (e.g., round, triangle, rectangle, polygon, and so on). The size of the swirl assembly 230 is not limited as well. This indicates that the shroud 234 can also be of any shape and size.

The swirl assembly 230 disturbs the flow of fluid—oxidant, fuel, diluents, other gas mixtures, or their combinations—prior to the fluid being delivered to the combustion chamber 12. While not shown, the swirl vanes 232 may optionally be provided with one or more fuel injection ports from which fuel may be delivered. With the shroud 234, the swirl assembly 230 can act as a swirling fuel nozzle, also referred to as a swozzle—to premix the premixture. With or without the shroud 234, the swirl vanes 232 can disturb the flow to increase or enhance uniform reactants, oxidants, and diluents mixture exiting from the non-swirl elements 220.

Figure 4:
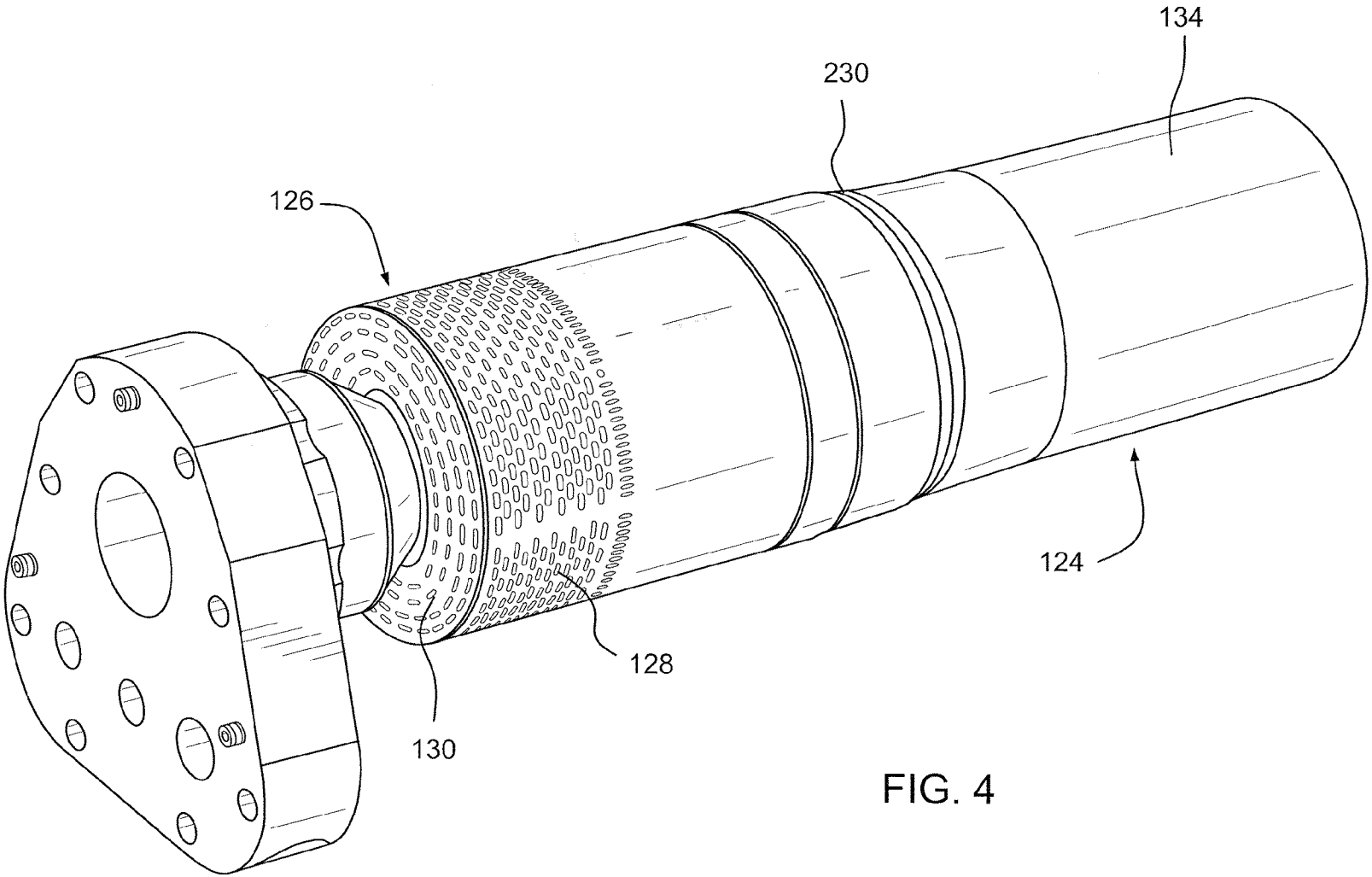
FIGS. 4 and 5 illustrate a fuel nozzle using a swirl assembly with a shroud according to an embodiment of the present invention.
Figure 5:
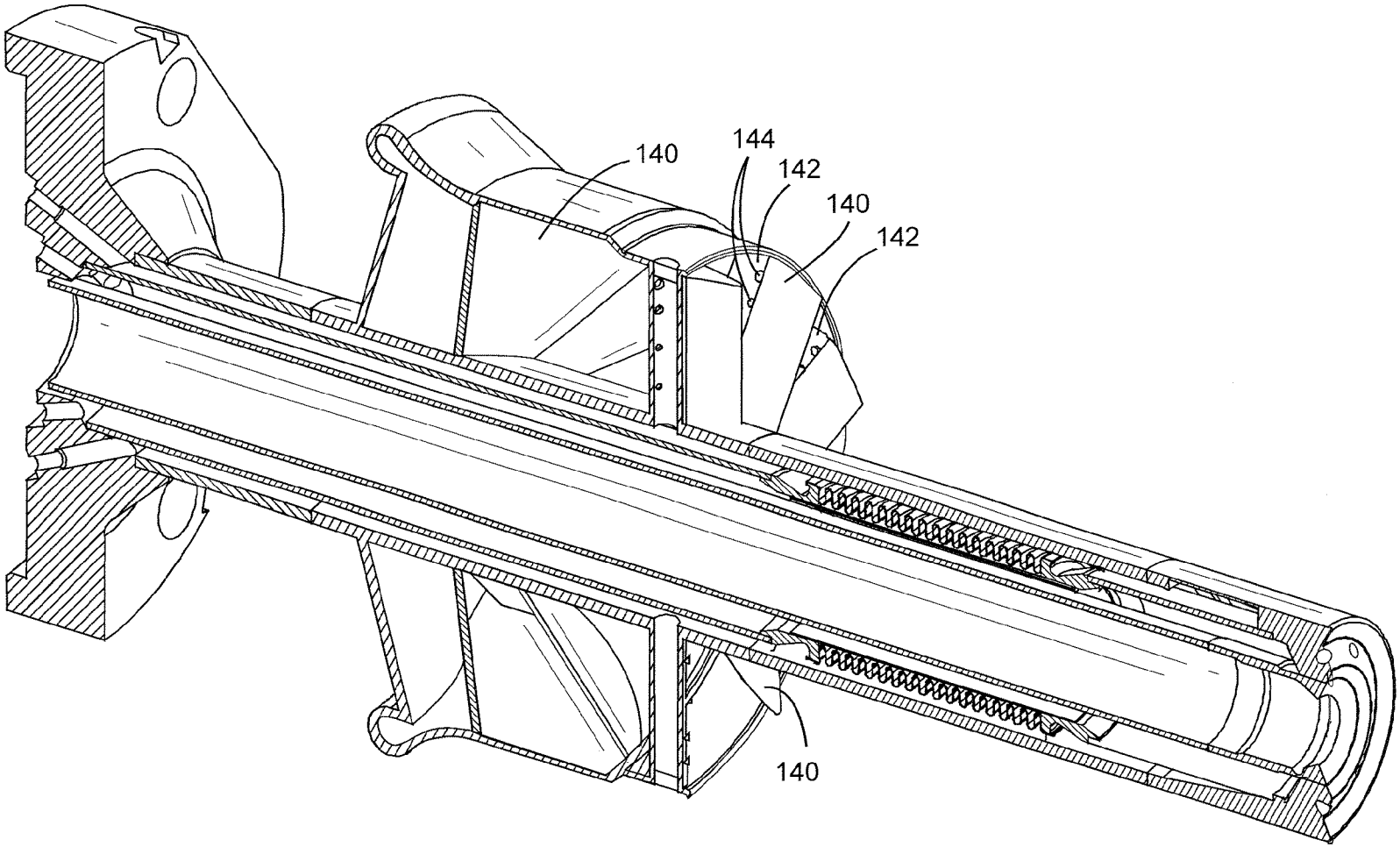

FIGS. 4 and 5 illustrate an example of a fuel nozzle using a swirl assembly with a shroud, i.e., a swozzle. In FIG. 4, the fuel nozzle includes an inlet flow conditioner (IFC) 126, a swozzle 230, and a shroud extension 134 which extends from the swirl assembly 230. Air or oxidant enters the swozzle via the IFC 126. The IFC 126 includes a perforated cylindrical outer wall 128 at the outside diameter, and a perforated end cap 130 at the upstream end. Oxidant enters the IFC 126 via the perforations in the end cap 130 and cylindrical outer wall 128. Referring to FIG. 5, the example swirl assembly includes vanes (labeled as 140 in this figure) and spokes 142 provided between the vanes 140. Each spoke 142 can include any number of injection ports (labeled as 144) for injecting fuel into the oxidant swirled by the vanes.

Referring back to FIG. 2, while a single swirl assembly 230 is shown, it is fully contemplated that the premixing apparatus 110 can include any number of swirl assemblies 230, some, none or all of which may include shrouds 234. Among those including the shroud 234, some may premix the premixture, i.e. some swirl assemblies may be swozzles. Regardless of whether any particular swirl assembly 230 is a swozzle or not, the assemblies 230 may be of varying shapes and sizes, and the shapes and sizes need not correspond to each other.

Figure 6:
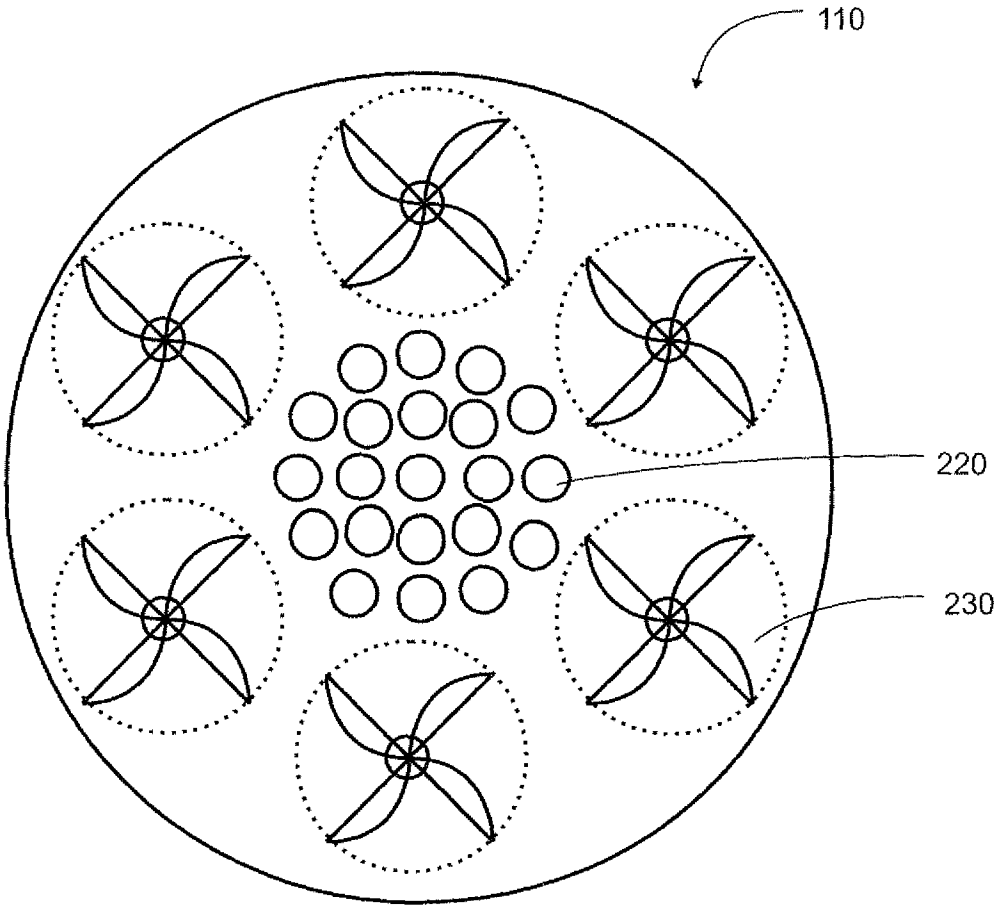
FIGS. 6 and 7 illustrate premixing apparatuses according to further embodiments of the present invention.
Figure 7:
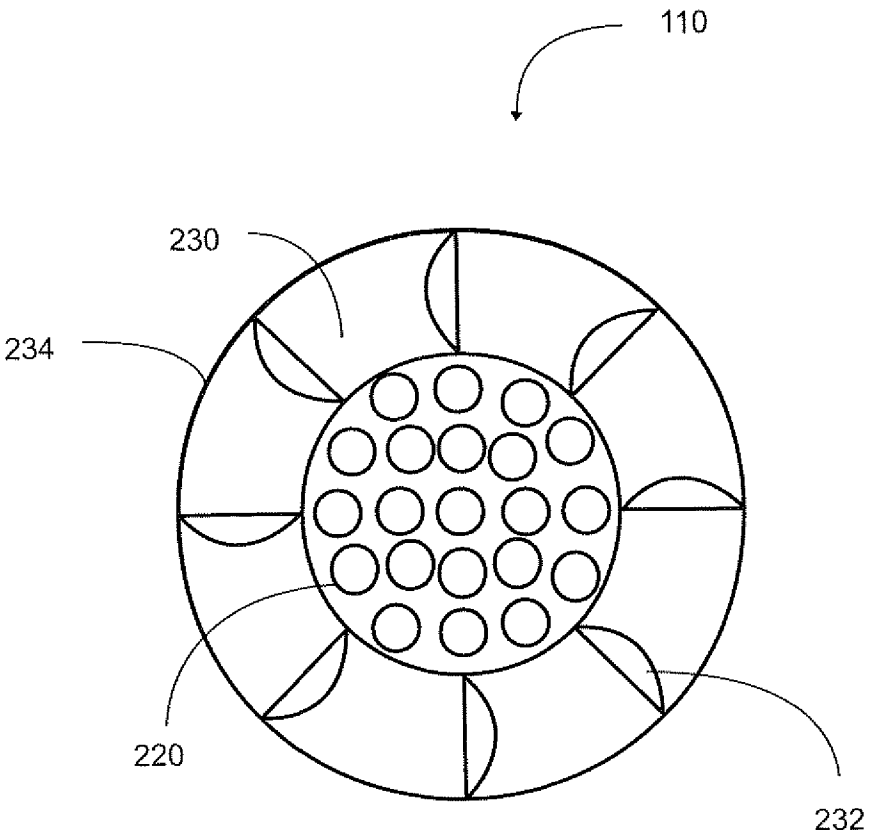

In FIG. 2, the circular swirl assembly 230 is located substantially at a center of the face 210 and is surrounded by circular non-swirl elements 220. While this may be a preferred location and geometrical shape of the swirl assembly 230, it should not be taken as a limitation. Indeed, the situation can be a reverse of FIG. 2, i.e., one or more non-swirl elements 220 can be surrounded by one or more swirl assemblies 230. An example of such a reversed premixing apparatus is illustrated in FIG. 6. The premixing apparatus 110 in FIG. 6 includes non-swirl elements 220 surrounded by a plurality of swirl assemblies 230, each of which can be a swozzle or not. However, instead of multiple swirl assemblies 230 surrounding the non-swirl elements 220, a single swozzle 230 can surround the non-swirl elements 220 as illustrated in FIG. 7.

The examples provided thus far demonstrate that the premixing apparatus 110 can include any number and any shape non-swirl elements 220, any number and any shape of swirl assemblies 230, and the non-swirl elements 220 and swirl assemblies 230 may be distributed on the face 210 in any manner. In addition, while not shown, the non-swirl elements 220 and the swirl assemblies 230 may have different intrusion on the flame side, i.e., they need not share the same end plane in the axial direction. When there are multiple non-swirl elements 220, they may have different intrusions from each other. The same is true when there are multiple swirl assemblies 230.

For much of this document, circularly shaped swirl assemblies 230 and non-swirl elements 220, with similar intrusions, distributed in a somewhat regular manner on a circular face 210 of a premixing apparatus 110 will be shown as examples. However, one should keep in mind that the scope of the disclosed subject matter is not to be limited by the illustrated examples unless otherwise specifically mentioned.

An example of a regular arrangement is a premixing apparatus 110 that includes a plurality of non-swirl elements 220 that are distributed around a periphery of the face 210 of the premixing apparatus 110 surrounding a swirl assembly 230 that is located substantially at a center of the face 210. Each non-swirl element 220 can premix the premixture prior to delivering the premixture to a combustor 14 of the gas turbine system 10. The swirl assembly 230 can include a plurality of swirl vanes 232 to disturb a flow of fluid, which can include the oxidant or the premixture, prior to delivering the fluid to the combustor 14. The swirl assembly 230 can be a swozzle.

In the above-described regular arrangement example, it is indicated that the premixing apparatus 110 includes "a" swirl assembly 230. This should not be taken to mean "only one" swirl assembly. Rather, this should be taken to mean "at least one" unless otherwise stated. Indeed, the term "a" should generally be taken to mean "at least one" unless otherwise stated.

Figure 8:
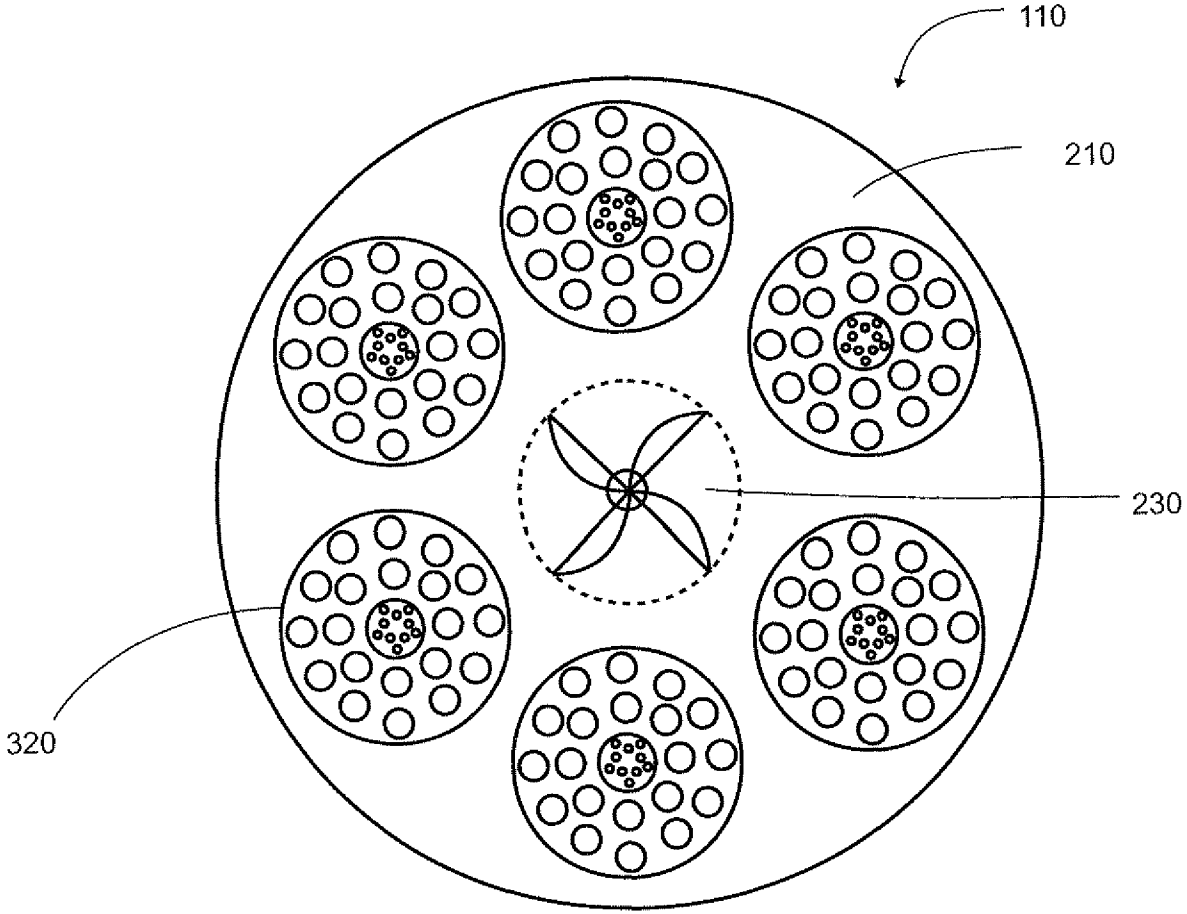
FIG. 8 illustrates a premixing apparatus with micromixers as non-swirl elements according to an embodiment of the present invention.
Figure 9:
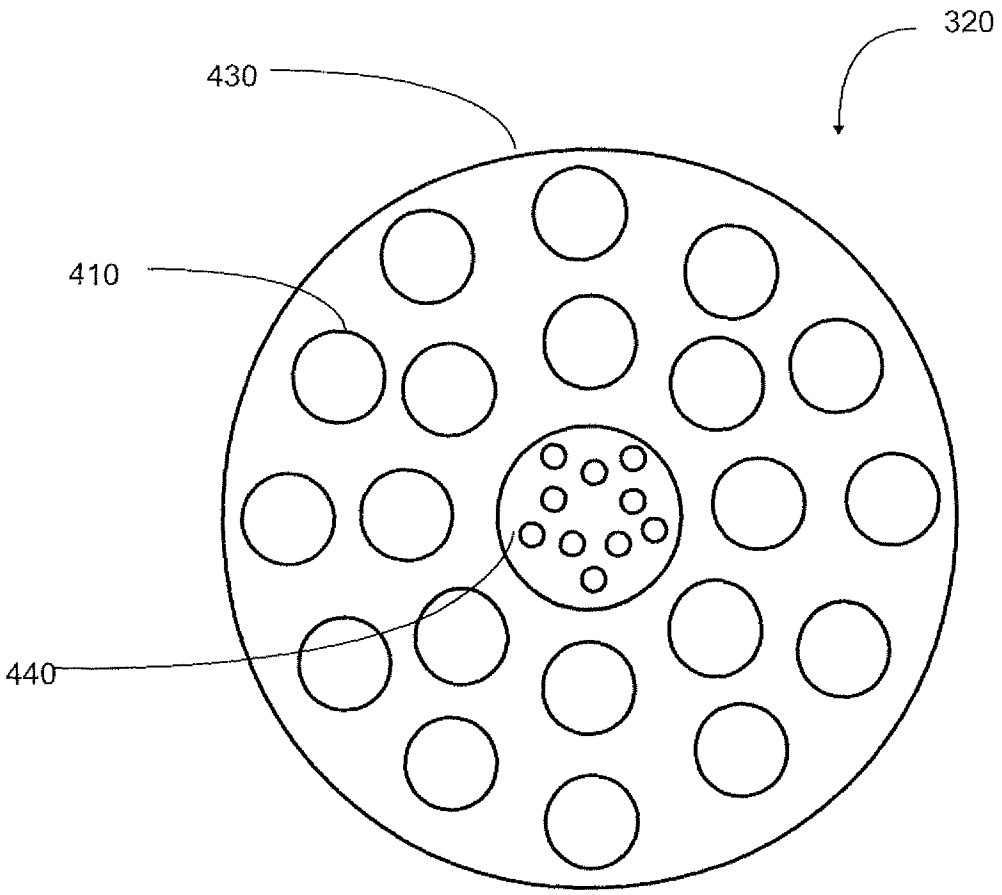
FIGS. 9 and 10 illustrate cross sections of micromixers according to further embodiments of the present invention.

FIG. 8 illustrates a regularly arranged premixing apparatus embodiment of the present invention. As seen, the premixing apparatus 110 includes a swirl assembly 230 surrounded by six tube bundles 320. The tube bundles 320 correspond to the non-swirl elements 220. FIG. 9 illustrates in more detail a cross-section of an example tube bundle 320. As seen, the tube bundle 320 includes multiple premixing mini-tubes 410 that are commonly grouped or attached so that the tube bundle 320 may function as a single fuel nozzle. In the example tube bundle 320 of FIG. 9, an enclosure 430 serves to commonly group or attach the premixing mini-tubes 410. The premixture can be premixed in each mini-tube 410, the premixture can be injected. The tube bundle 320 may also be referred to as a micromixer 320. Optionally, each micromixer 320 may incorporate one or more resonators 440. The micromixers 320 allow for a large flame holding margin, very low emissions, as well as wide MWI range operations.

The mini-tubes 410, the enclosure 430, and the resonator 440 are all shown to be circular, but as with the non-swirl elements 220 and swirl assemblies 230, the shapes and sizes of the elements 410, 430, 440 of the tube bundle 320 are not so limited. Also, there can be any number of resonators 440 including none at all. Further, the resonators 440 need not be centered. Indeed, there is little to no limitations on the distribution of the elements that make up the tube bundle 320.

Figure 10:
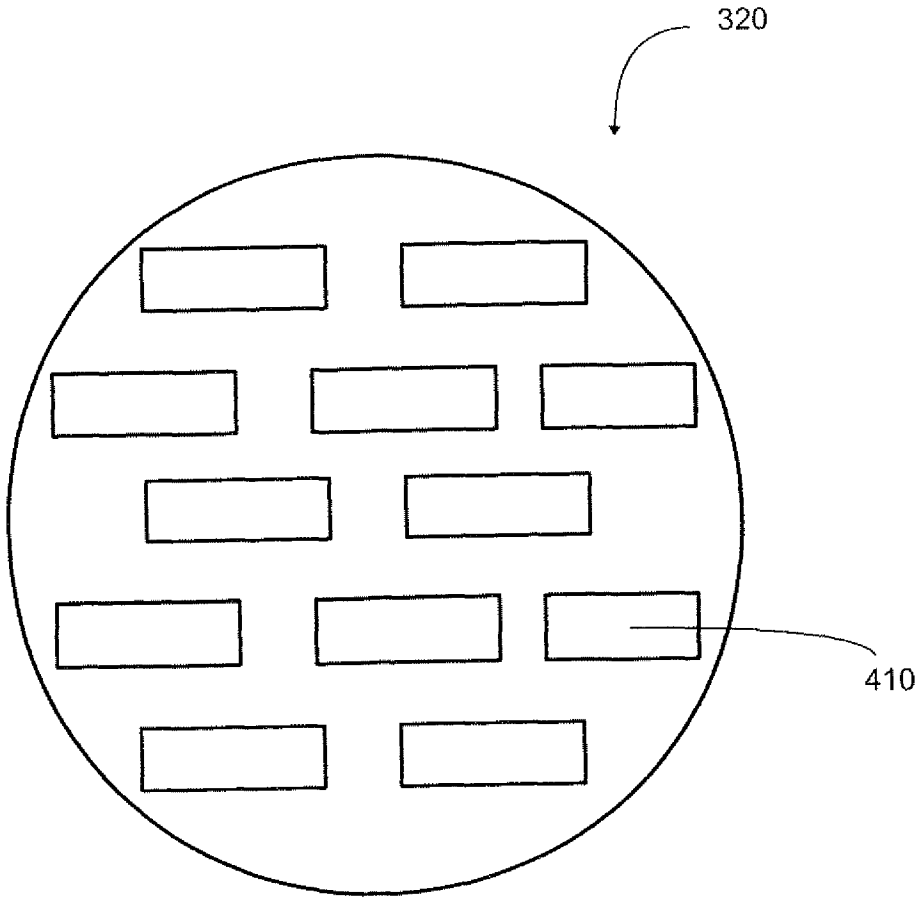

Other tube bundle configurations are possible as illustrated in FIG. 10 in which the tube bundle 320 includes a plurality of rectangularly shaped mini-tubes 410. It should be understood that the configurations are not limited to those illustrated in FIGS. 9 and 10.

Referring back to FIG. 8, the swirl assembly 230 in the illustrated embodiment is a centrally located swozzle. But as cautioned above, the invention is not so limited. Although such regular arrangement may be preferred, the swirl assembly 230 need not be centrally located. Also, the swirl assembly 230 need not include the shroud 234. Further, multiple swirl assemblies 230 may be provided each with or without the shroud 234. It bears repeating that there is little to no limit to the number of swirl assemblies 230 and tube bundles 320, and there is also little to no limit to the geometrical shapes. Further, the tube bundles 320 need not be identical in geometry, mini-tube count, mini-tube sizes, resonator count, resonator sizes, etc.

Figure 11:
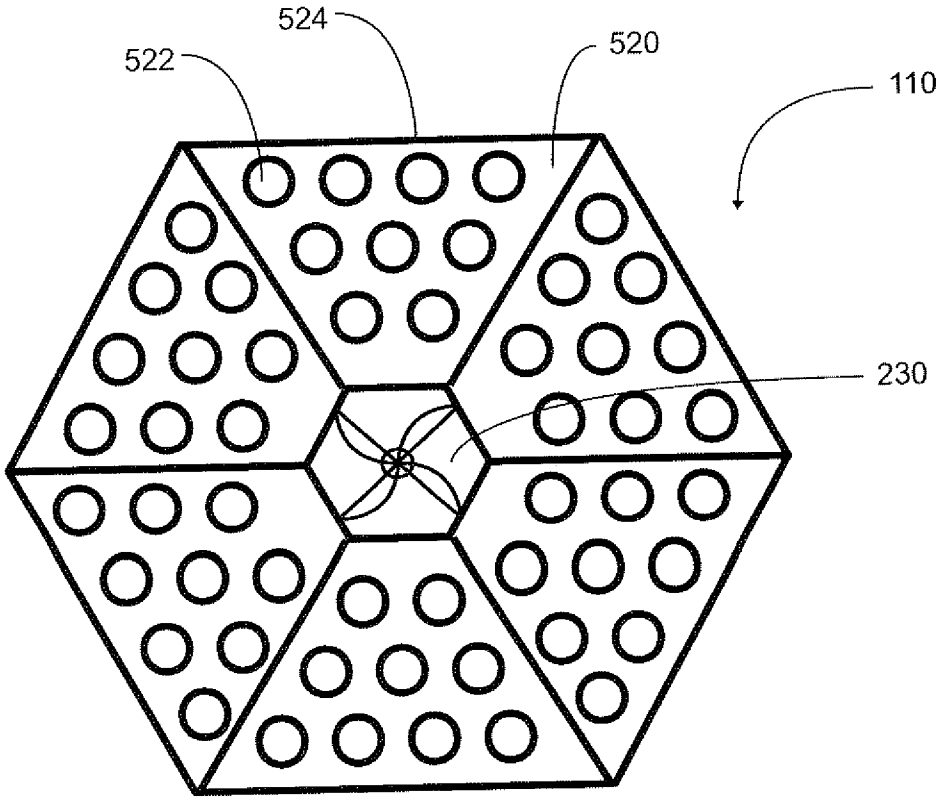
FIG. 11 illustrates a premixing apparatus with rich-catalytic, lean burn nozzles as non-swirl elements according to an embodiment of the present invention.

FIG. 11 illustrates another regularly arranged premixing apparatus embodiment of the present invention. As seen, the premixing apparatus 110 includes a non-circular swirl assembly 230 and six rich-catalytic, lean burn (RCL) nozzles 520 which correspond to the non-swirl elements. In this particular instance, the RCL nozzles 520 are trapezoidal, but the shape is not so limited. As the name suggests, the premixture is passed over a catalyst to enhance lean flame stability.

Each RCL nozzle 520 comprises one or multiple conduits 522 within a trapezoidal shell 524. To minimize clutter, fuel injection holes and ports are not shown. The premixture is assumed to flow internal to the shell 524 and external to the conduits 522 in a direction normal to the plane the figure. The premixture may also flow within the swirl assembly 230. The conduits 522 and shells 524 are thickly shaded to indicate that the surfaces exposed to the premixture—the exterior surfaces of the conduits 522 and the interior surfaces of the shells 524—are coated with catalytic material such as platinum or palladium. Optionally, the conduits 522 can be used to carry a coolant.

While the shell 524 is shown to be trapezoidal in FIG. 11, other shapes are contemplated. Again, while regular arrangement may be preferred, the shells 524 need not be geometrically identical. Even when their geometries are similar, they can be of different sizes. In addition, while a single centrally located non circular swirl assembly 230 is shown in the figure, multiple swirl assemblies of varying shapes, with or without shrouds also of varying shapes, distributed about the face of the premixing apparatus are fully contemplated.

Figure 12:
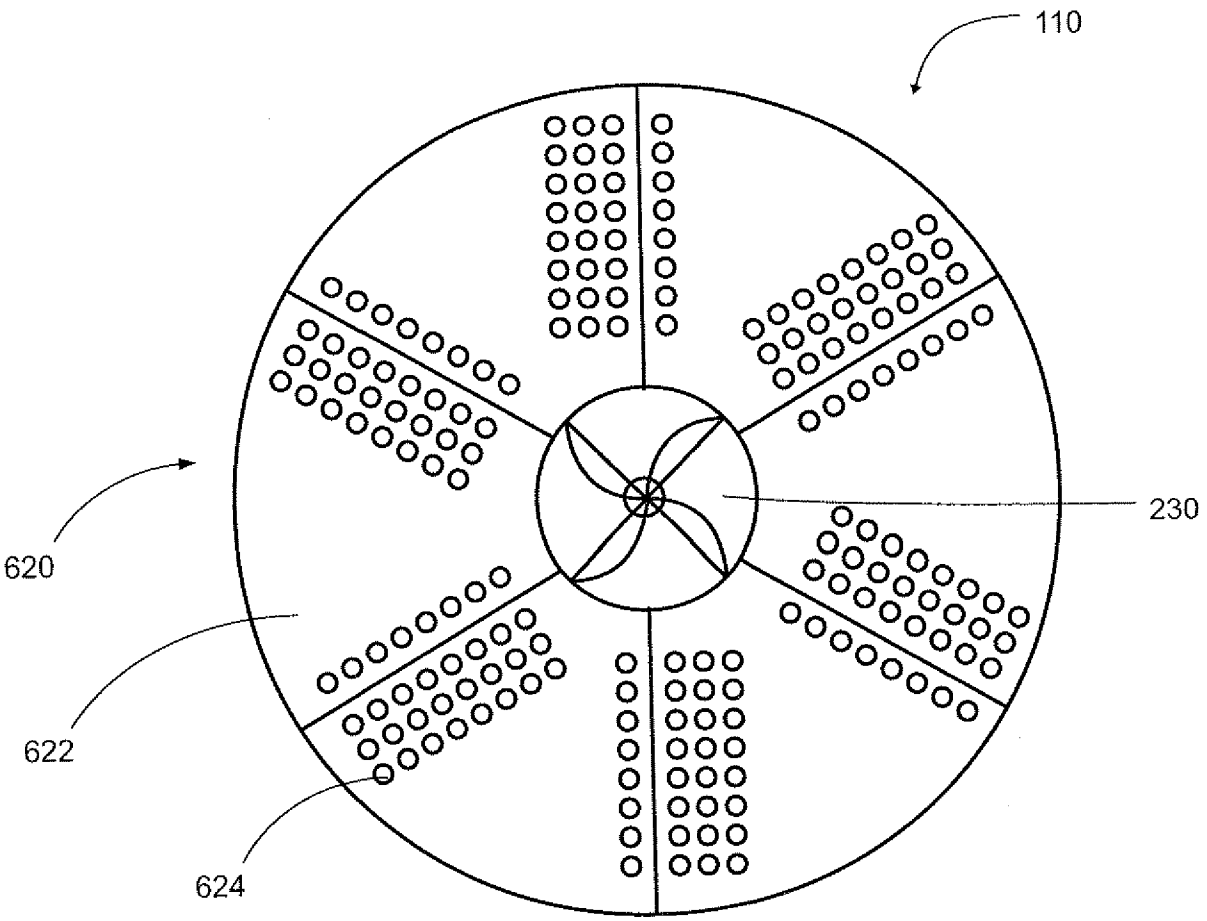
FIG. 12 illustrates a premixing apparatus with sector nozzles as non-swirl elements according to an embodiment of the present invention.

FIG. 12 illustrates a further regularly arranged premixing apparatus embodiment of the present invention. As seen, the premixing apparatus 110 includes a non circular swirl assembly 230 (need not be circular as shown) and sector nozzles 620. In this particular instance, the number of sector nozzles 620, which correspond to the non-swirl elements, is six, but this is not a limitation. As seen, each sector nozzle 620 is provided with a plate 622, which may be apertured, formed with an array of orifices 624 from which the premixture flows out.

It should come as no surprise that many variations in the premixing apparatus 110 are fully contemplated. The premixing apparatus 110 can include any number of non-swirl elements 220 and any number of swirl assemblies 230. While there should be at least one of each, the numbers of the non-swirl elements 220 and the swirl assemblies 230 need not correspond to each other in any way. The non-swirl elements 220 and the swirl assemblies 230 may be distributed about the face 210 of the premixing apparatus 110 in any manner, and the intrusions on the flame side of the non-swirl elements 220 and the swirl assemblies 230 may vary as well.

The swirl assemblies 230 can be of any shapes and sizes, and the shape and sizes need not correspond with each other. Among the swirl assemblies 230, there can be any number with the shrouds 234 (including zero) and any number without the shrouds 234 (including zero). The non-swirl elements 220 can also be of any shapes and sizes, and the shape and sizes need not correspond with each other. Among the non-swirl elements 220, there can be any number of micromixers 320 (including zero), RCL nozzles 520 (including zero) and sector nozzles 620 (including zero). These are not the only examples of non-swirl elements 220. The micromixers 320 need not all be the same. For example, some may include resonators 440 and others may not. The RCL nozzles 520 need not all be the same, e.g., some may carry coolant and others may not. Likewise, the sector nozzles 620 need not all be the same.

A non-exhaustive list of advantages of various aspects of the premixing apparatus includes low combustion dynamics, low emissions, enhanced lean flame holding margin, and a wide MWI operation range.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A premixing apparatus for a gas turbine combustor, the premixing apparatus comprising:

a fuel inlet configured to receive fuel and direct the fuel into the premixing apparatus;

a swirl assembly at a center of a face of the premixing apparatus, the swirl assembly including swirl vanes, wherein each of the swirl vanes includes a fuel injection port in fluid communication with the fuel inlet and through which fuel is delivered from the fuel injection port to mix the fuel with oxidant flowing around the swirler vanes to produce a first fuel/oxidant mixture which flows to a combustion chamber for combustion; and non-swirl elements surrounding the swirl assembly, each non-swirl element comprising a respective micromixer including a group of tubes arranged in a respective tube bundle, each respective tube bundle having tubes relatively closely spaced from one another as compared to a spacing from tubes of another tube bundle, wherein each micromixer is in fluid communication with the fuel inlet and fuel and oxidant are premixed within each tube to produce a second fuel/oxidant mixture flowing from the non-swirl elements to the combustion chamber for combustion.

2. The premixing apparatus of claim 1, wherein at least one micromixer comprises a resonator within the respective tube bundle.

3. The premixing apparatus of claim 1, wherein the swirl assembly is a swozzle comprising a shroud surrounding the swirl vanes.

4. The premixing apparatus of claim 1, wherein at least one of the non-swirl elements has a different intrusion on a flame side than the swirl assembly.

5. The premixing apparatus of claim 1, wherein the non swirl elements are sector nozzles, each sector nozzle including a first arcuate side, a second arcuate side radially outward from the first arcuate side, a pair of radial sides joining the first arcuate side to the second arcuate side, and a plate including orifices extending through the plate, and wherein each tube bundle is aligned with the orifices in the plate to allow the second fuel/oxidant mixture to flow to the combustion chamber.

6. The premixing apparatus of claim 1, wherein at least one of the first fuel/oxidant mixture and the second fuel/oxidant mixture includes a liquid, a diluent, a gas, or a combination thereof, in addition to fuel and oxidant.

* * * * *